US010330370B2

(12) United States Patent
Choi et al.

(10) Patent No.: US 10,330,370 B2
(45) Date of Patent: Jun. 25, 2019

(54) REFRIGERATOR

(71) Applicant: Samsung Electronics Co., Ltd, Gyeonggi-do (KR)

(72) Inventors: Sung Pil Choi, Seongnam-si (KR); Cheon Seok Ko, Suwon-si (KR); Sang Yong Lee, Gwangju (KR); Hyun Gil Jeon, Gwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/841,232

(22) Filed: Dec. 13, 2017

(65) Prior Publication Data

US 2018/0172337 A1 Jun. 21, 2018

(30) Foreign Application Priority Data

Dec. 15, 2016 (KR) ..... 10-2016-0172026

(51) Int. Cl.

| | |
|---|---|
| ***F25D 23/02*** | (2006.01) |
| ***E06B 1/00*** | (2006.01) |
| ***F25D 23/10*** | (2006.01) |
| ***A47F 3/04*** | (2006.01) |
| *F25D 11/00* | (2006.01) |

(52) U.S. Cl.

CPC ..... *F25D 23/028* (2013.01); *A47F 3/043* (2013.01); *E06B 1/00* (2013.01); *F25D 23/02* (2013.01); *F25D 23/10* (2013.01); *F25D 11/00* (2013.01)

(58) Field of Classification Search

CPC ..... F25D 23/028; F25D 23/10; F25D 11/00; F25D 2323/02; F25D 2323/024; A47B 2096/208; A47B 88/956; E05D 7/0407; E05D 7/0415; E05D 7/0423

USPC ..... 312/405

See application file for complete search history.

(56) References Cited

U.S. PATENT DOCUMENTS

| | | | | |
|---|---|---|---|---|
| 2,184,532 | A * | 12/1939 | Schroeder | E05D 7/081 16/236 |
| 3,890,670 | A * | 6/1975 | Sewing | E05D 7/0407 16/236 |
| 6,079,164 | A * | 6/2000 | Lanzani | A47L 15/4251 248/316.1 |
| 6,681,446 | B2 * | 1/2004 | Compagnucci | A47B 96/06 16/236 |
| 8,371,551 | B2 | 2/2013 | Jang | |
| 8,506,026 | B2 * | 8/2013 | Kim | F25D 23/028 312/405 |

(Continued)

FOREIGN PATENT DOCUMENTS

| | | |
|---|---|---|
| EP | 0647821 | * 10/1994 |
| EP | 2405089 A2 | 1/2012 |

(Continued)

*Primary Examiner* — Daniel J Troy
*Assistant Examiner* — Timothy M Ayres

(57) ABSTRACT

Disclosed herein is a refrigerator may include a cabinet, a door which opens a front of the cabinet, a panel disposed in front of the door, and a coupling unit which couples the panel with the door. And the coupling unit may include a first adjustor provided to adjust a position of the panel in a left and right direction, a second adjustor provided to adjust a position of the panel in an up and down direction, and a third adjustor provided to adjust a position of the panel in a front and rear direction.

4 Claims, 12 Drawing Sheets

(56) References Cited

U.S. PATENT DOCUMENTS

| | | | | |
|---|---|---|---|---|
| 8,651,590 | B2 * | 2/2014 | Wilson | F25D 23/10 312/204 |
| D756,423 | S | 5/2016 | Tres et al. | |
| 9,605,457 | B2 * | 3/2017 | Humble | E05D 7/04 |
| 9,752,817 | B2 * | 9/2017 | Richards | F25D 23/028 |
| 2004/0222725 | A1 * | 11/2004 | Park | A47B 77/08 312/405 |
| 2015/0184928 | A1 * | 7/2015 | Ozyuksel | F25D 23/10 312/326 |
| 2017/0198507 | A1 * | 7/2017 | Humble | E05D 7/04 |

FOREIGN PATENT DOCUMENTS

| | | | |
|---|---|---|---|
| EP | 2638341 | A2 | 9/2013 |
| KR | 100512728 | B1 | 9/2005 |
| KR | 100512734 | B1 | 9/2005 |
| KR | 100526823 | B1 | 11/2005 |
| KR | 101233204 | B1 | 2/2013 |
| KR | 101437984 | B1 | 9/2014 |
| KR | 101461432 | B1 | 11/2014 |
| KR | 20150000102 | A | 1/2015 |
| KR | 20160020872 | A | 2/2016 |
| WO | 2012062665 | A2 | 5/2012 |

* cited by examiner

REFRIGERATOR

CROSS-REFERENCE TO RELATED APPLICATION

This application is related to and claims priority to Korean Patent Application No. 10-2016-0172026 filed on Dec. 15, 2016, the disclosure of which is incorporated herein by reference.

TECHNICAL FIELD

Embodiments of the present disclosure relate to a refrigerator, and more particularly, to a refrigerator on which a door panel adjustment apparatus is mounted.

BACKGROUND

Generally, a refrigerator is a home appliance which includes a storage compartment which stores food and a cold air supply apparatus which supplies cold air to the storage compartment to keep food fresh.

There are currently built-in refrigerators that blend in with peripheral furniture or apparatuses in a place in which the refrigerator is disposed and effectively utilize space.

The built-in refrigerator may include an additional panel on the front of the door to match with peripheral furniture or apparatuses as the body of the refrigerator is accommodated therein.

Here, since it is difficult to adjust alignment of a panel when the panel is installed at the door of the built-in refrigerator, it becomes a limitation.

SUMMARY

To address the above-discussed deficiencies, it is a primary object to provide a refrigerator including a panel adjustment apparatus capable of easily adjusting alignment of a panel.

Additional aspects of the present disclosure will be set forth in part in the description which follows and, in part, will be obvious from the description, or may be learned by practice of the present disclosure.

In accordance with one aspect of the present disclosure, a refrigerator may include a cabinet, a door which opens a front of the cabinet, a panel disposed in front of the door, and a coupling unit which couples the panel with the door. And the coupling unit may include a first adjustor provided to adjust a position of the panel in a left and right direction, a second adjustor provided to adjust a position of the panel in an up and down direction, and a third adjustor provided to adjust a position of the panel in a front and rear direction.

The coupling unit further includes a base bracket coupled to an end of the door and a coupling bracket coupled to a rear surface of the panel, and the first adjustor includes a first door bracket extending upward from the base bracket and configured to have a surface parallel to the panel in the left and right direction, a first panel bracket extending rearward from the coupling bracket and disposed to face the first door bracket, and a first adjustment member configured to pass through the first door bracket in the left and right direction of the panel and to pressurize the first panel bracket in the left and right direction of the panel.

The second adjustor includes a second panel bracket extending rearward from the coupling bracket and disposed to be parallel to the base bracket, a second adjustment member configured to comprise a mounting portion on which the second panel bracket is mounted in the up and down direction of the panel, and a coupling hole disposed on the base bracket to allow the second adjustment member to be screw-coupled therewith in the up and down direction of the panel.

The third adjustor includes a second door bracket extending upward from the base bracket and disposed to face the coupling bracket and a third adjustment member configured to pass through the second door bracket and coupled with the coupling bracket. And the third adjustment member includes a coupling screw coupled with the coupling bracket and a pressurizing screw configured to pressurize the coupling bracket.

The first door bracket comprises a first through hole through which the first adjustment member passes, and the first adjustment member includes a first rotator provided at one end of the first adjustment member, a first screw part extending from the first rotator and configured to pass through the first through hole, and an end portion provided at the other end of the first adjustment member and in contact with the first door bracket.

The first adjustment member moves the first door bracket to one side by moving the end portion forward when the first rotator rotates in one direction, and the first adjustment member moves the first door bracket to an opposite side by moving the end portion backward when the first rotator rotates in an opposite direction.

The base bracket and the first door bracket are integrally formed with each other.

The first panel bracket is provided to extend downward from one side of the second panel bracket.

The coupling bracket, the first panel bracket, and the second panel bracket are integrally formed with each other.

The second adjustment member further includes a second rotator provided between one end of the second adjustment member and the mounting portion, and a second screw part extending from the mounting portion to the other end of the second adjustment member. And the second panel bracket includes a second through hole through which the second rotator passes, and a mounting surface in contact with the mounting portion.

The second adjustment member moves the second door bracket downward by moving the mounting portion downward when the second rotator rotates in one direction, and the second adjustment member moves the second door bracket upward by moving the mounting portion upward when the second rotator rotates in an opposite direction.

The coupling unit further includes a penetrating member through which the first adjustor, the second adjustor, and the third adjustor pass, and the first adjustor comprises a first adjustment member which passes through the penetrating member in the left and right direction of the panel, and the second adjustor comprises a second adjustment member which passes through the penetrating member in the up and down direction of the panel, and the third adjustor comprises a third adjustment member which passes through the penetrating member in the front and rear direction of the panel.

The coupling unit further includes a base bracket coupled to an end portion of the door, and a pair of first door brackets extending upward from the base bracket and disposed on left and right sides of the penetrating member, and the first adjustment member includes a rotator provided at one end of the first adjustment member and supported by one of the first door brackets, a screw part configured to pass through the penetrating member, and a supporter provided at the other end of the first adjustment member and supported by the other of the pair of first door brackets.

The coupling unit further includes a coupling bracket coupled to a rear surface of the panel, and an extension portion extending rearward from the coupling bracket and provided to be parallel to the base bracket, and the second adjustment member includes a mounting portion on which the extension portion is mounted in the up and down direction of the panel and a screw part configured to pass through the penetrating member in the up and down direction of the panel and to be coupled with the base bracket.

The coupling unit further includes a coupling bracket coupled to a rear surface of the panel and a second door bracket extending upward from the base bracket and disposed in the rear of the penetrating member, and the third adjustment member passes through the second door bracket and the penetrating member in the front and rear direction of the panel and is screw-coupled with the coupling bracket.

In accordance with another aspect of the present disclosure, a refrigerator may include a cabinet, a door configured to open a front of the cabinet, a panel disposed in front of the door, a panel coupling bracket disposed on a rear surface of the panel, a base bracket disposed at an end portion of the door, a door coupling bracket extending upward from the base bracket and coupled with the panel coupling bracket in a front and rear direction of the panel by a coupling member, a door adjustment bracket extending upward from the base bracket and configured to have a surface in parallel in a left and right direction of the panel, a panel adjustment bracket extending rearward from the door coupling bracket and disposed to face the door adjustment bracket, and an adjustment member configured to pass through the door adjustment bracket and come into contact with the panel adjustment bracket to adjust a position of the panel in the left and right direction.

The panel coupling bracket further comprises a height adjustment member on which an extension bracket is mounted, the extension bracket extending downward from the panel coupling bracket and disposed to be parallel to the base bracket to be mounted, and which is screw-coupled with the base bracket in the up and down direction of the panel to move the extension bracket in the up and down direction.

The panel adjustment bracket is extended downward from one side of the extension bracket.

The refrigerator further includes a front and rear adjustment member configured to pass through the door coupling bracket and come into contact with the panel coupling bracket to adjust the position of the panel in the front and rear direction.

The adjustment member moves forward to one side and moves the panel adjustment bracket to the one side while rotating in one direction, and the adjustment member moves backward from the one side and moves the panel adjustment bracket to an opposite side while rotating in an opposite direction.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
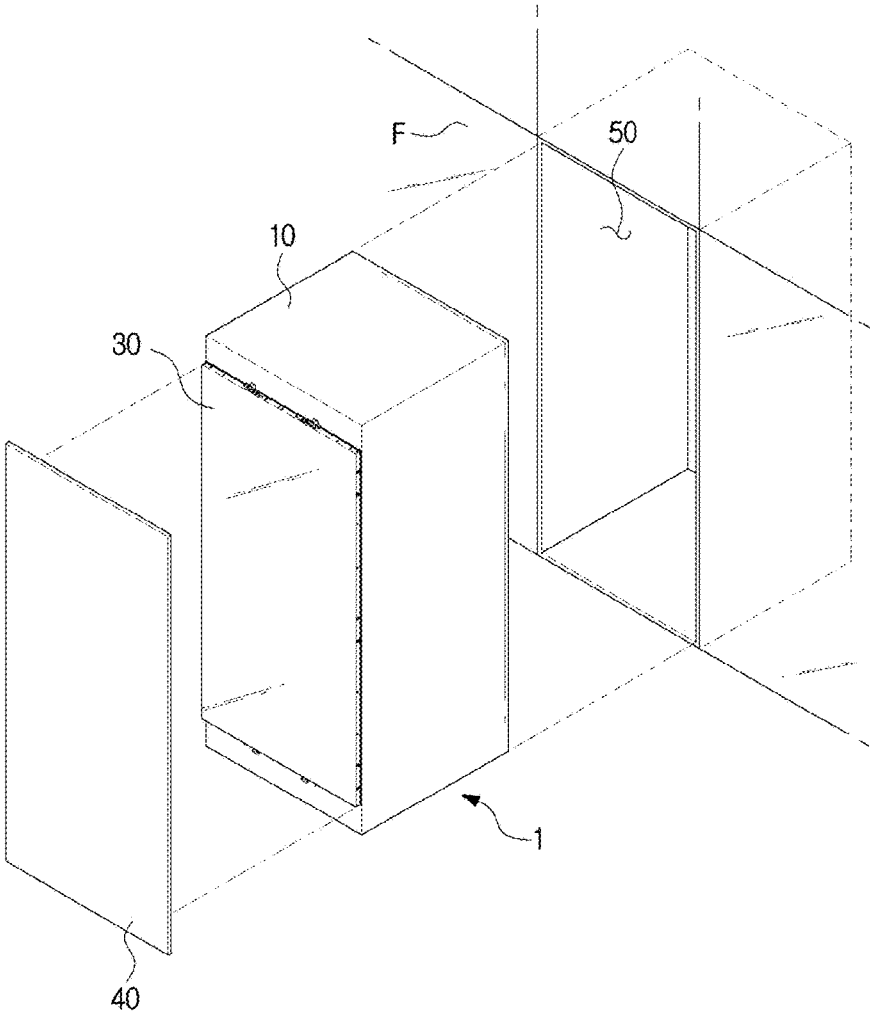
FIG. 1 is an exploded perspective view of a refrigerator, a panel, and an accommodation portion accommodated according to an embodiment of the present disclosure.

FIGS. 1 through 9, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments disclosed in the specification and components shown in the drawings are merely preferable examples of the present disclosure and various modifications capable of replacing the embodiments and drawings of the specification may be made at the time of filing the present application.

Also, throughout the drawings of the present specification, like reference numerals or symbols refer to components or elements configured to perform substantially identical functions.

Also, the terms used herein are intended to explain the embodiments but are not intended to limit and/or define the present disclosure. Singular forms, unless defined otherwise in context, include plural forms. Throughout the specification, the terms "comprise", "have", and the like are used herein to specify the presence of stated features, numbers, steps, operations, elements, components or combinations thereof but do not preclude the presence or addition of one or more other features, numbers, steps, operations, elements, components, or combinations thereof.

Also, even though the terms including ordinals such as "first", "second", and the like may be used for describing various components, the components will not be limited by the terms and the terms are used only for distinguishing one element from others. For example, without departing from the scope of the present disclosure, a first component may be referred to as a second component, and similarly, the second component may be referred to as the first component. The term "and/or" includes any and all combinations or one of a plurality of associated listed items.

Hereinafter, the embodiments will be described in detail with reference to the attached drawings.

The terms "upper side", "upward", "lower side", and "downward" used herein are described according to a vertical direction of a refrigerator according to one embodiment of the present invention and shown in FIG. 1, that is, a side corresponding to a top of the refrigerator in FIG. 1 refers to an upper side and a bottom below the top refers to an lower side.

Also, in the case of the terms "front" and "rear" used herein, a direction in which an opening and a door of the refrigerator according to one embodiment of the present disclosure and shown in FIG. 1 are disposed refers to a front and a direction opposite thereto refers to a rear.

Generally, a refrigerator is a home appliance which includes a storage compartment which stores food and a cold air supply apparatus which supplies cold air to the storage compartment to keep food fresh. Types of refrigerators may be classified by door and shapes of a storage compartment.

There are top mounted freezer (TMF) refrigerators in which a storage compartment is partitioned into top and bottom by a horizontal partition such that a freezer compartment is formed on an upper side and a refrigerator compartment is formed on a lower side, and there are bottom mounted freezer (BMF) refrigerators in which a refrigerator compartment is formed on an upper side and a freezer compartment is formed on a lower side.

Also, there are side-by-side (SBS) refrigerators in which a storage compartment is partitioned into left and right sides by a vertical partition such that a freezer compartment is formed on one side and a refrigerator compartment is formed on the other side, and there are French door refrigerators (FDR) in which a storage compartment is partitioned into top and bottom by a horizontal partition such that a refrigerator compartment is formed on an upper side and a freezer compartment is formed on a lower side while the refrigerator compartment on the upper side is opened and closed by a pair of doors.

In the embodiment, a refrigerator including one storage compartment will be described. However, although a refrigerator including one storage compartment will be described for convenience of description, the present disclosure is not limited thereto and may be applied to an SBS refrigerator, an FDR, and the like.

Figure 2:
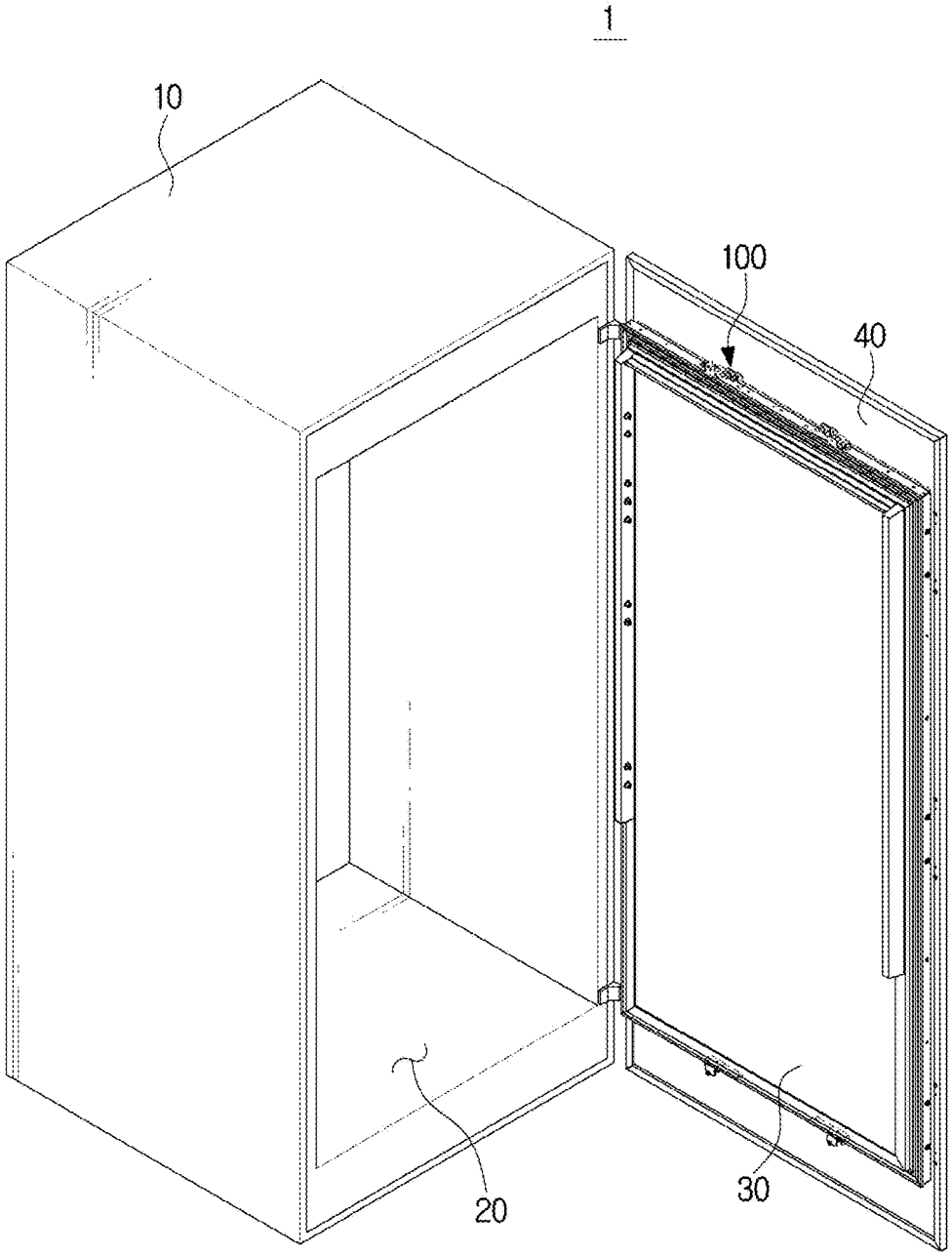
FIG. 2 is a perspective view of a state in which a door of a refrigerator is opened according to an embodiment of the present disclosure.

FIG. 1 is an exploded perspective view illustrating a refrigerator, a panel, and a cabinet in which the refrigerator is disposed according to one embodiment of the present disclosure, and FIG. 2 is a perspective view illustrating a state in which a door of the refrigerator is open.

A refrigerator 1 includes a cabinet 10, a storage compartment 20 formed in the cabinet 10, a door 30 which opens and closes the storage compartment 20, and a cold air supply apparatus (not shown) which supplies cold air to the storage compartment 20.

The cabinet 10 may include an inner casing which forms the storage compartment 20, an outer casing which is coupled to an outside of the inner casing and forms an exterior, and an insulator formed between the inner casing and the outer casing to insulate the storage compartment 20.

The cold air supply apparatus may generate cold air by using a cooling circulation cycle of compressing, condensing, expanding, and evaporating a refrigerant.

The refrigerator 1 according to one embodiment of the present disclosure may be a built-in refrigerator. Accordingly, the refrigerator 1 may be provided in an accommodation portion 50 in which the refrigerator 1 is accommodated. A flank portion F in which a piece of furniture or another home appliance is disposed may be formed on a side of the accommodation portion 50.

The refrigerator 1 may include a panel 40 disposed in front of the door 30 and capable of matching with the flank portion F. The panel 40 may be provided to have a size corresponding to an opening of the accommodation portion 50. Also, the panel 40 may be formed to have a color or a material corresponding to that of the flank portion F to match with the flank portion F.

The panel 40 may be coupled with the door 30 by a coupling unit 100 and be rotated with the door 30. Hereinafter, the coupling unit 100 will be described in detail.

Figure 3:
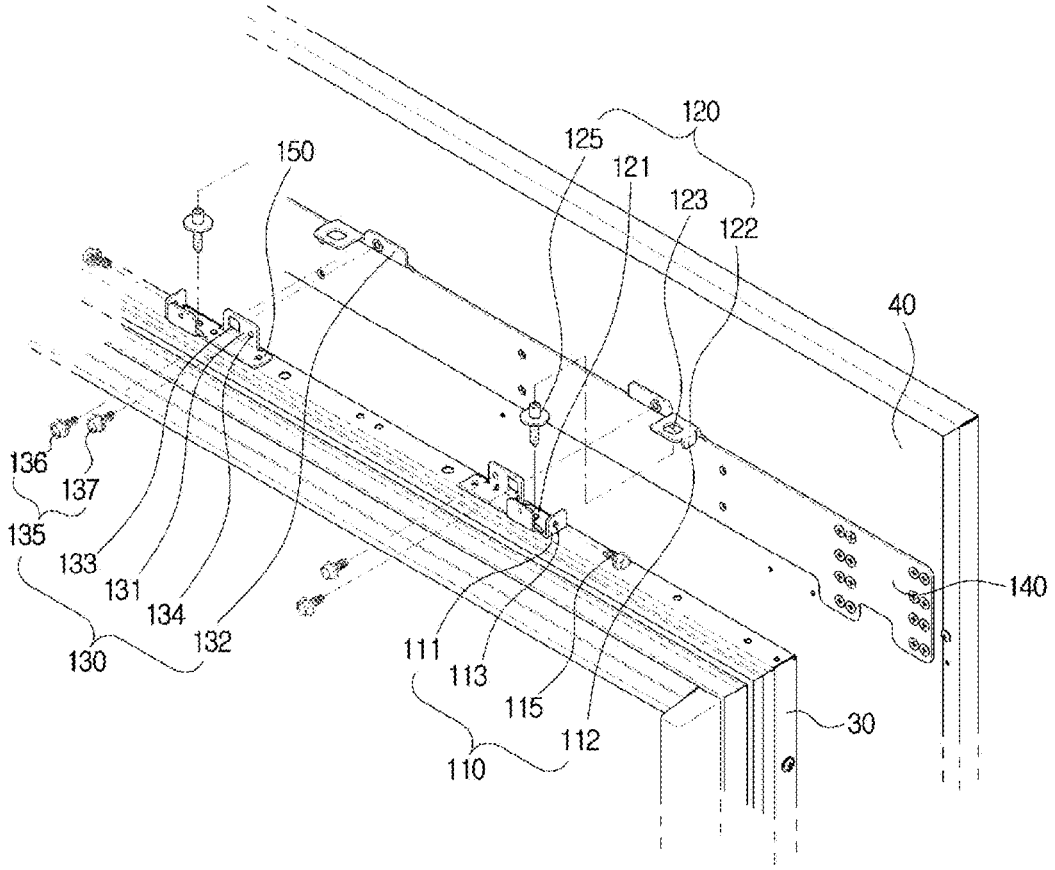
FIG. 3 is an exploded perspective view of a unit of a combined refrigerator according to an embodiment of the present disclosure.

FIG. 3 is an exploded perspective view of the coupling unit of the refrigerator according to one embodiment of the present disclosure.

A conventional coupling unit includes an adjustor formed to allow a panel to be coupled to a door and for adjusting a position of the panel coupled to the door. The adjustor may adjust the position of the panel by minutely moving the panel in a front and rear direction and an up and down direction of the panel using a screw and the like. However, since a minute movement of the panel in a left and right direction is impossible, a user may adjust a position of the panel by directly moving the panel in the left and right direction, or an additional coupling device may be included to adjust in the left and right direction of the panel.

However, the coupling unit 100 according to one embodiment of the present disclosure may minutely move the panel 40 in a front and rear direction, an up and down direction, and a left and right direction by using one component. That is, the panel 40 may be minutely moved in three directions by using only one coupling unit 100 without any additional components.

That is, the coupling unit 100 may include a first adjustor (or a left and right direction adjustor) 110, a second adjustor (or an up and down direction adjustor) 120, and a third adjustor (or a front and rear direction adjustor) 130.

The coupling unit 100 may include the three adjustors 110, 120, and 130 such that the user may easily adjust a position of the panel 40 in three directions. After the position of the panel 40 is adjusted, the panel 40 may be completely coupled to the door 30 by a coupling means.

As shown in FIG. 3, a pair of such coupling units 100 may be provided at a top end of the door 30. Since the pair of coupling units 100 are symmetrical to each other, one of the pair of coupling units 100 (the coupling unit provided on a left side in FIG. 1) will be described and repetitive descriptions will be omitted.

The coupling unit 100 may include a coupling bracket (or a panel-coupling bracket) 140 disposed on a rear surface of the panel 40 and coupled to the door 30. Also, the coupling unit 100 may include a base bracket 150 which is provided at the top end of the door 30, is coupled to the coupling bracket 140, and has an extended form.

The component which forms the three adjustors 110, 120, and 130 extends from the coupling bracket 140 and the base bracket 150 such that the panel 40 may be adjustable in three directions. Accordingly, it is possible to easily adjust the position of the panel 40 in three directions by using only minimum components.

The first adjustor 110 may include a first door bracket (or a door adjustment bracket) 111 extending upward from the base bracket 150 and having a surface parallel to the left and right direction of the panel 40, a first panel bracket (or a panel adjustment bracket) 112 extending in the rear of the coupling bracket 140 and disposed to face the first door bracket 111, and a first adjustment member 115 which passes through the first door bracket 111 in the left and right direction of the panel 40 and pressurizes the first panel bracket 112 in the left and right direction of the panel 40.

The first adjustment member 115 passes through a first through hole 113 provided at the first door bracket 111 to be fixed to the first door bracket 111 and is disposed to come into contact with the first panel bracket 112 such that the position of the panel 40 may be adjusted in the left and right direction, which will be described below in detail.

The second adjustor 120 may include a second panel bracket (or an extension bracket) 122 extended rearward from the coupling bracket 140 and disposed to be parallel to the base bracket 150, a second adjustment member (or a height adjustment member) 125 which includes a mounting portion on which the second panel bracket 122 is mounted in the up and down direction of the panel 40, and a coupling hole 121 provided at the base bracket 150 to allow the second adjustment member 125 to be screw-coupled thereto in the up and down direction of the panel 40.

The second panel bracket 122 includes a second through hole 123 through which at least a part of the second adjustment member 125 passes, and at least the part of the second adjustment member 125 passes through the second through hole 123 and is capable of adjusting the position of the panel 40 in the up and down direction by moving in the up and down direction, which will be described below in detail.

The third adjustor 130 may include a second door bracket (or a door coupling bracket) 131 extending from an upper side of the base bracket 150 and disposed to face the coupling bracket 140 and a third adjustment member (or a front and rear adjustment member or coupling member) 135 which passes through the second door bracket 131 and is coupled to the coupling bracket 140.

The third adjustment member 135 may include a coupling screw 136 coupled to the coupling bracket 140 and a pressurizing screw 137 which pressurizes the coupling bracket 140. The second door bracket 131 may include a third through hole 133 through which the coupling screw 136 passes.

The position of the panel 40 is adjustable in the front and rear direction by coupling between the coupling screw 136 and the pressurizing screw 137, which will be described below in detail.

Figure 4A:
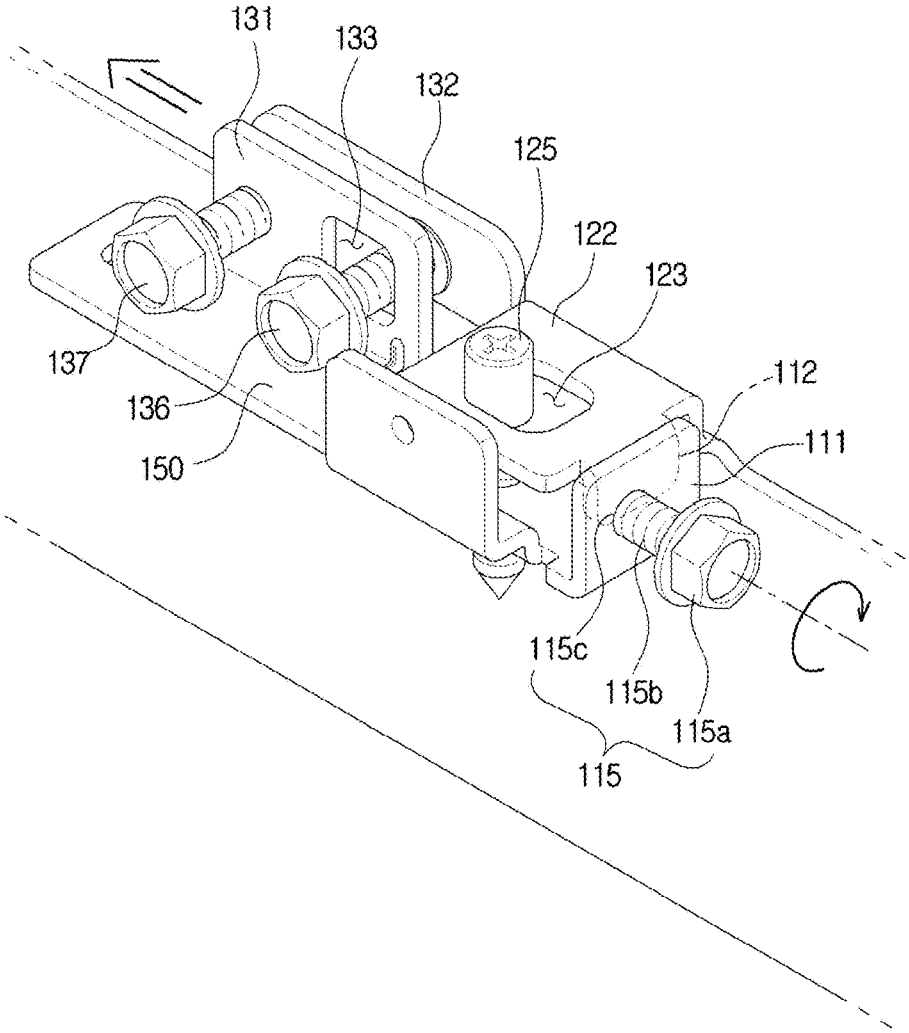
FIG. 4A is a cross-sectional view illustrating a state in which the position of the panel is adjusted to one side by a left and right direction adjustor of the refrigerator according to one embodiment of the present disclosure
Figure 4B:
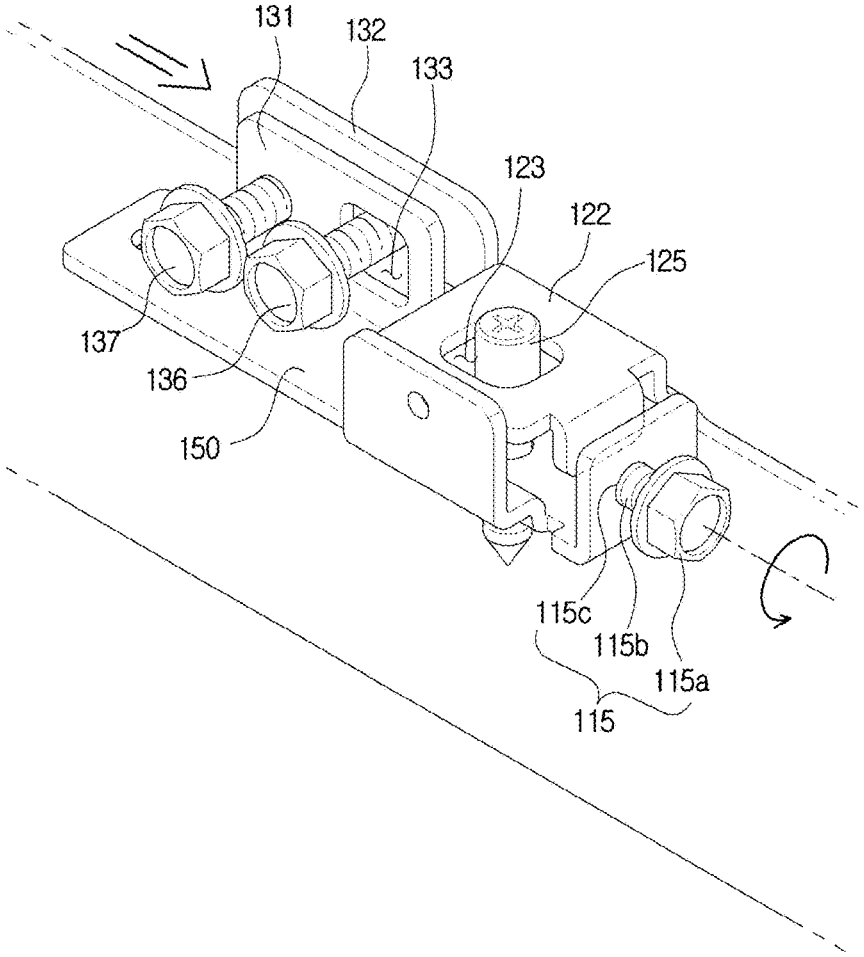
FIG. 4B is a cross-sectional view illustrating a state in which the position of the panel is adjusted to the other side by the left and right direction adjustor of the refrigerator according to one embodiment of the present disclosure.

Hereinafter, the first adjustor 110 will be described in detail. FIG. 4A is a cross-sectional view illustrating a state in which the position of the panel is adjusted to one side by a left and right direction adjustor of the refrigerator according to one embodiment of the present disclosure, and FIG. 4B is a cross-sectional view illustrating a state in which the position of the panel is adjusted to the other side by the left and right direction adjustor of the refrigerator according to one embodiment of the present disclosure.

As described above, the first adjustor 110 may adjust the position of the panel 40 in the left and right direction.

In detail, the first door bracket 111 and the first panel bracket 112 may be disposed to face each other. The first panel bracket 112 may be provided to be disposed further inside than the first door bracket 111 depending on a center of the door 30.

The first adjustment member 115 may be provided to pass through the first door bracket 111 in an outside to inside direction depending on the center of the door 30 and come into contact with the first panel bracket 112.

The first door bracket 111 may include the first through hole 113 through which the first adjustment member 115 passes. The first adjustment member 115 may include a first rotator 115*a* rotated by the user, a first screw part 115*b* which passes through the first through hole, and an end portion 115*c* which comes into contact with the first panel bracket 112.

The first screw part 115*b* may pass through the first through hole 113 and be coupled to the first through hole 113.

As shown in FIG. 4A, when the user rotates the first rotator 115*a* in one direction, the first screw part 115*b* is rotated to move from the first door bracket 111 to the first panel bracket 112 such that the end portion 115*c* may pressurize the first panel bracket 112 toward the center of the door 30.

The first panel bracket 112 is a component extending from the coupling bracket 140 such that the coupling bracket 140 may be interconnected to and moved according to movement of the first panel bracket 112 and the panel 40 coupled to the coupling bracket 140 may be also interconnected to the movement of the first panel bracket 112 and moved in a direction in which the first panel bracket 112 is moved.

That is, as the first adjustment member 115 pressurizes the first panel bracket 112 in a right direction, the panel 40 may be moved in a right direction with respect to the door 30.

As the first adjustment member 115 pressurizes the first panel bracket 112 to one side, the second panel bracket 122 extending from the coupling bracket 140 may be also moved to one side. Accordingly, the second through hole 123 provided at the second panel bracket 122 may be moved and may make contact with the second adjustment member 125. Here, to prevent this, the second through hole 123 may be provided to be larger than a diameter of a part of the second adjustment member 125 inserted in the second through hole.

Accordingly, the part of the second adjustment member 125 may be moved by a certain distance within the second through hole 123 such that even when the panel 40 is moved to one side, the second through hole 123 may not be restricted by the second adjustment member 125 and may be interconnected thereto and moved.

As the first adjustment member 115 pressurizes the first panel bracket 112 to one side, the coupling screw 136 coupled to the coupling bracket 140 may be also moved to one side. Accordingly, as the coupling screw 136 is moved, the third through hole 133 positioned at the second door bracket 131 through which the coupling screw 136 passes may make contact with the coupling screw 136. To prevent this, the third through hole 133 may be provided to be larger than a diameter of the coupling screw 136 inserted in third through hole 133.

Accordingly, the coupling screw 136 may be moved by a certain distance within the third through hole 133 such that even when the panel 40 is moved to one side, the coupling screw 136 may not be restricted by the third through hole 133 and may be linked thereto and moved.

As shown in FIG. 4B, when the user rotates the first rotator 115*a* in an opposite direction, the first screw part 115*b* is counter-rotated to move from the first panel bracket 112 to the first door bracket 111 such that the end portion 115*c*, which pressurizes the first panel bracket 112, and the first panel bracket 112 may be spaced apart.

Accordingly, the first panel bracket 112 may not be moved to one side, and the first adjustment member 115 may pressurize the first panel bracket 112 to the other side due to the first adjustor 110 of one of the pair of coupling units 100, disposed on a right side.

Here, as shown in FIG. 4B, since the first adjustment member 115 of one of the pair of coupling units 100, disposed on a left side, may be provided to be recessed from the center of the door 30, even when a pressure is applied to the other side of the panel 40, the panel 40 may be moved to the other side without restriction.

Since the second adjustment member 125 and the coupling screw 136 are movable by a certain distance within the second through hole 123 and the third through hole 133, respectively, even when the panel 40 is moved to the other side, the movement of the panel 40 may not be restricted.

Figure 5A:
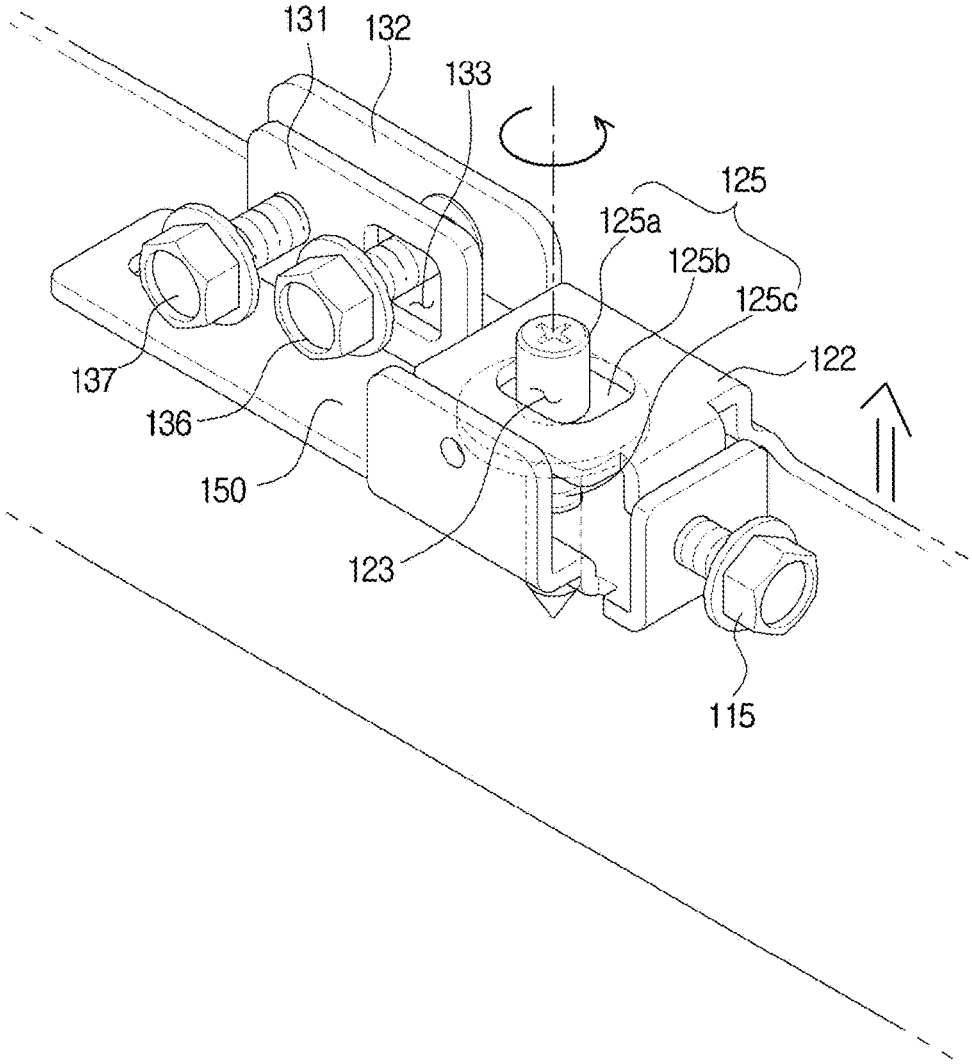
FIG. 5A is a cross-sectional view illustrating a state in which the position of the panel is adjusted upward by an up and bottom direction adjustor of the refrigerator according to one embodiment of the present disclosure.
Figure 5B:
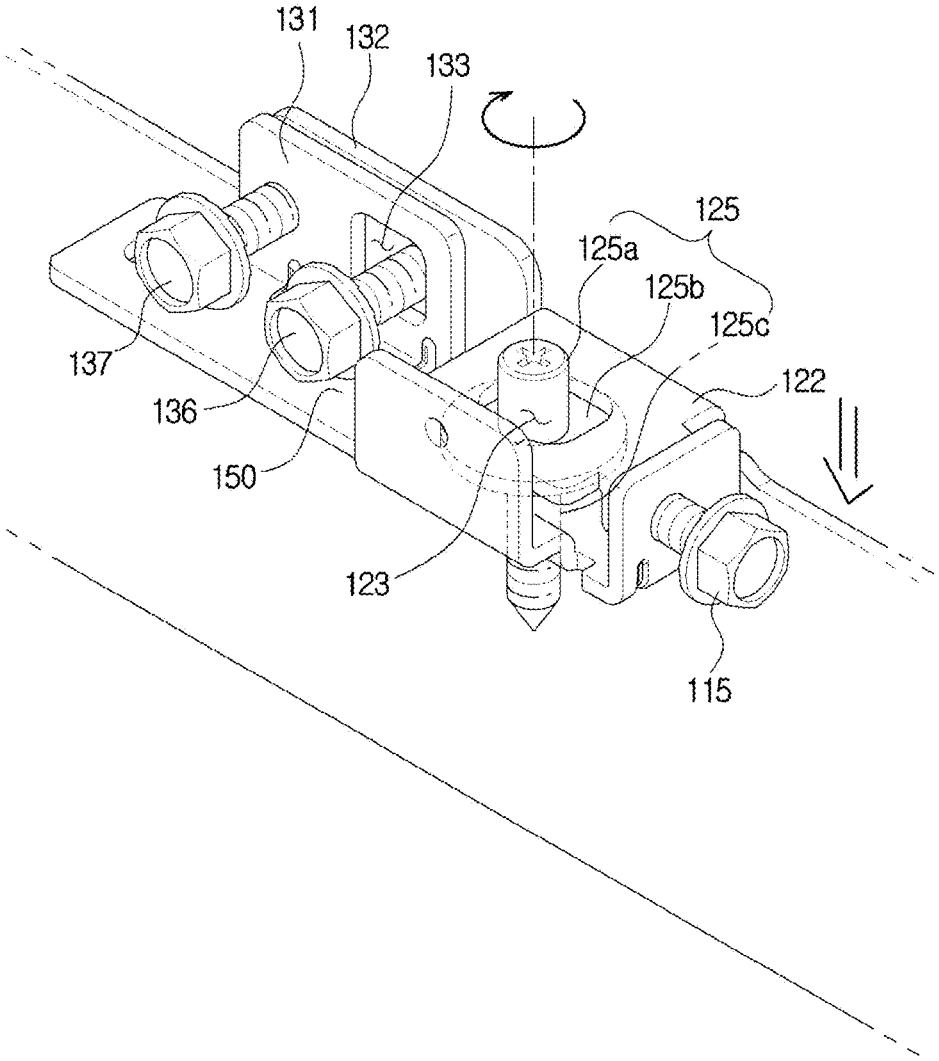
FIG. 5B is a cross-sectional view illustrating a state in which the position of the panel is adjusted downward by the up and down direction adjustor of the refrigerator according to one embodiment of the present disclosure.

Hereinafter, the second adjustor 120 will be described in detail. FIG. 5A is a cross-sectional view illustrating a state in which the position of the panel is adjusted upward by an up and bottom direction adjustor of the refrigerator according to one embodiment of the present disclosure, and FIG. 5B is a cross-sectional view illustrating a state in which the position of the panel is adjusted downward by the up and down direction adjustor of the refrigerator according to one embodiment of the present disclosure.

As described above, the second adjustor 120 may adjust the position of the panel 40 in the up and down direction.

In detail, the second adjustor 120 may include the second panel bracket 122 extending rearward from the coupling bracket 140 and disposed to be parallel to the base bracket 150 in the up and down direction. The second panel bracket 122 may be mounted on the second adjustment member 125, be screw-coupled to the base bracket 150 in the up and down direction, and be moved in the up and down direction according to an up and down direction movement of the second adjustment member 125 such that the position of the panel 40 in the up and down direction may be adjusted.

The second panel bracket 122 may include the second through hole 123 through which the second adjustment member 125 passes. The second adjustment member 125 may include a second rotator 125*a* which passes through the second through hole 123 and is rotatable by the user, a mounting portion 125*b* on which the second panel bracket 122 is mounted in the up and down direction, and a second screw part 125*c* screw-coupled to the coupling hole 121 provided at the base bracket 150 in the up and down direction.

The second adjustment member 125 may be provided to allow one end of the second screw part 125*c* to be screw-coupled to the coupling hole 121 and vertically coupled to the base bracket 150, to allow the mounting portion 125*b* provided on the other end of the second screw part 125*c*, and may be extended to have a surface in a direction parallel to the base bracket 150 to be fixed parallel to the base bracket 150.

The second adjustment member 125 may further include the second rotator 125*a* extended from the mounting portion 125*b* in the up and down direction and capable of passing through the second through hole 123.

The second panel bracket 122 may be disposed to allow the second rotator 125*a* to pass through the second through hole 123 and to come into contact with a top surface of the mounting portion 125*b*. That is, a bottom surface of the second panel bracket 122 may be disposed to pass through the second rotator 125*a* and come into contact with the mounting portion 125*b* to be mounted on the second adjustment member 125.

In this state, when the second rotator 125*a* of the second adjustment member 125 is rotated to one side, screw-coupling between the second screw part 125*c* and the coupling hole 121 is released at a certain part and accordingly the second screw part 125*c* moves upward such that the second panel bracket 122 may move upward.

Since the second panel bracket 122 is a component extended from the rear of the coupling bracket 140, the coupling bracket 140 moves upward due to upward movement of the second panel bracket 122 such that the position of the panel 40 is moved upward.

Since it is necessary for the mounting portion 125*b* to continuously support the second panel bracket 122 even when the panel 40 is moved in the left and right direction or the front and rear direction, the mounting portion 125*b* may be provided to be larger than the second through hole 123. Accordingly, as described above, the mounting portion 125*b* may stably support the second panel bracket 122 even when the second rotator 125*a*, which is a part of the second adjustment member 125, moves by a certain distance within the second through hole 123.

As described above, since the third through hole 133 is provided to allow the coupling screw 136 to be movable by a certain distance within the third through hole 133, even when the coupling screw 136 is linked to the upward movement of the second panel bracket 122 and is moved upward, the coupling screw 136 may not be restricted by the third through hole 133 and may be movable.

As shown in FIG. 5B, when the second rotator 125*a* of the second adjustment member 125 is rotated to an opposite side, screw-coupling between the second screw part 125*c* and the coupling hole 121 is tightened and accordingly the second screw part 125*c* moves downward such that the second panel bracket 122 may move downward.

In a conventional up and down direction adjustor which adjusts an up and down direction, a coupling bracket of a panel is disposed at a screw member such as a bolt, a bracket of the panel is coupled by connecting a pair of nuts in an up and down direction of the screw member, and the pair of nuts are rotated to move in the up and down direction to adjust an up and down direction of the bracket such that a position of the panel in the up and down direction may be adjusted.

However, as described above, the up and down direction adjustor (or the second adjustor) 120 according to one embodiment of the present disclosure may mount the second panel bracket 122 using one component, that is, the second adjustment member 125, such that the user may easily adjust the position of the panel 40 in the up and down direction.

The second panel bracket 122 of the second adjustor 120 and the first panel bracket 112 of the first adjustor 110 may be integrated with the coupling bracket 140 (refer to FIG. 4A). In detail, the second panel bracket 122 may be extended downward from the coupling bracket 140 to be parallel to the base bracket 150, and the first panel bracket 112 parallel to the panel 40 in the left and right direction may be extended downward from one side of the second panel bracket 122.

Accordingly, the coupling bracket 140, the first panel bracket 112, and the second panel bracket 122 may be formed as one component such that the panel 40 may be adjusted in the up and down direction and the left and right direction through one component.

Figure 6A:
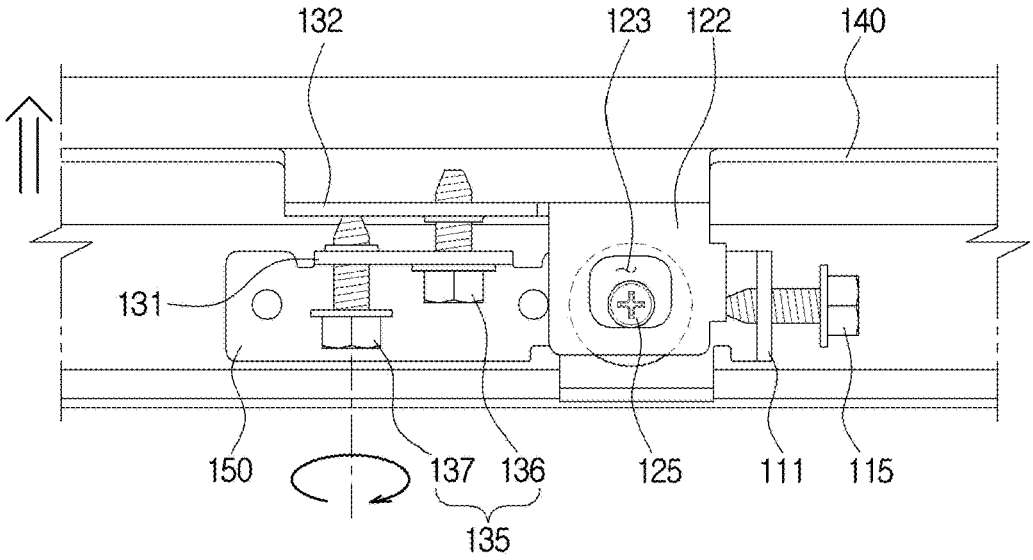
FIG. 6A is a cross-sectional view illustrating a state in which the position of the panel is adjusted toward a front side by a front and rear direction adjustor of the refrigerator according to one embodiment of the present disclosure.
Figure 6B:
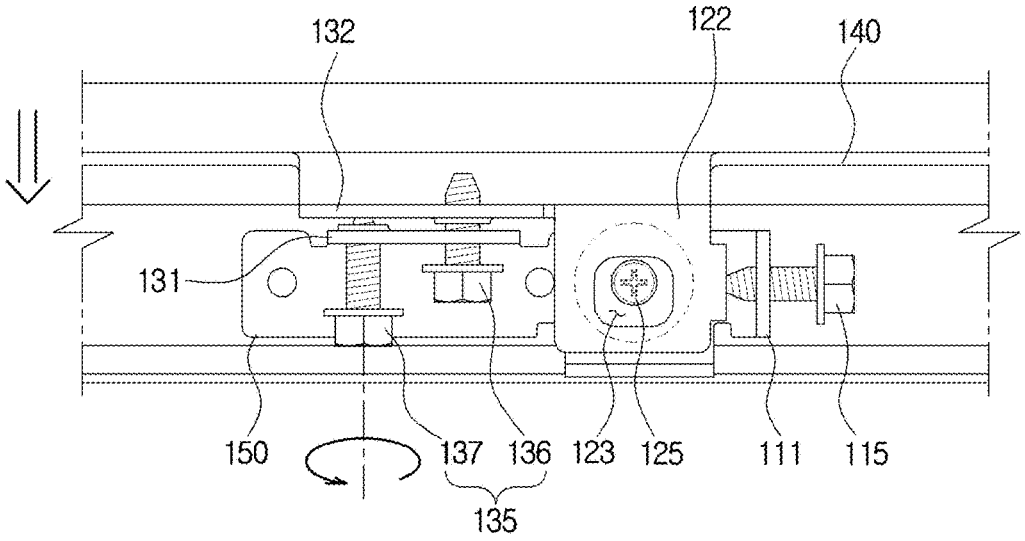
FIG. 6B is a cross-sectional view illustrating a state in which the position of the panel is adjusted toward a rear side by the front and rear direction adjustor of the refrigerator according to one embodiment of the present disclosure.

Hereinafter, the third adjustor 130 will be described in detail. FIG. 6A is a cross-sectional view illustrating a state in which the position of the panel is adjusted toward a front side by a front and rear direction adjustor of the refrigerator according to one embodiment of the present disclosure, and FIG. 6B is a cross-sectional view illustrating a state in which the position of the panel is adjusted toward a rear side by the front and rear direction adjustor of the refrigerator according to one embodiment of the present disclosure.

As described above, the third adjustor 130 may adjust the position of the panel 40 in the front and rear direction.

In detail, the third adjustor 130 may include the second door bracket 131 extending upward from the base bracket 150 and disposed to be parallel to the coupling bracket 140 in the front and rear direction. The coupling bracket 140 may include a coupling portion 132 provided at a position corresponding to the second door bracket 131 (refer to FIG. 3).

The third through hole 133 and a fourth through hole 134 configured to allow the third adjustment member 135 to pass therethrough from a rear to a front of the panel 40 may be provided at the second door bracket 131.

The coupling screw 136 may pass through the third through hole 133 and be coupled to the coupling portion 132. Also, a pressurizing screw 137 may pass through the fourth through hole 134 and be coupled to the coupling portion 132.

The coupling screw 136 may be coupled with the coupling portion 132 and may move while linked to the panel 40 as the panel 40 is moved. As described above, the third through hole 133 is provided to be larger than a diameter of the coupling screw 136 and is not restricted by the third through hole 133 even when the coupling screw 136 moves with the panel 40.

As shown in FIG. 6A, when the pressurizing screw 137 rotates in one direction while the coupling screw 136 is coupled with the coupling portion 132, the pressurizing screw 137 which passes through the fourth through hole 134 moves forward into the panel 40 and pressurizes the coupling portion 132 in contact therewith toward the front of the panel 40. Accordingly, the panel 40 may move forward.

When the panel 40 is moved forward, the second panel bracket 122 extended in the rear of the coupling bracket 140 is also moved. Here, the second through hole 123 is provided to be larger than a diameter of the second rotator 125*a* inserted in the second through hole 123 in order to not allow the second adjustment member 125 which passes through the second panel bracket 122 and the second panel bracket 122 to make contact with each other such that the second rotator 125*a* may be provided not to restrict movement of the second panel bracket 122.

As shown in FIG. 6B, when the pressurizing screw 137 is counter-rotated, the pressurizing screw 137 which passes through the fourth through hole 134 moves backward toward the rear of the panel 40, completing forward-pressurizing to the coupling portion 132.

Here, when the coupling screw 136 is rotated to loosen coupling between the coupling screw 136 and the coupling portion 132, the panel 40 may be moved backward. Accordingly, the panel 40 may be moved rearward.

The second door bracket 131 of the third adjustor 130 and the first door bracket 111 of the first adjustor 110 may be integrated with the base bracket 150. In detail, the second door bracket 131 may be extended to be parallel to the coupling bracket 140 above the base bracket 150, and the first door bracket 111 may be extended to be parallel in the left and right direction of the panel 40.

Accordingly, the base bracket 150, the first door bracket 111, and the second door bracket 131 may be formed as one component such that the panel 40 may be adjusted in the up and down direction and the front and rear direction through one component.

The coupling unit 100 may be provided at the top end of the door 30 as described above but may be additionally provided at a bottom end of the door 30 to be symmetrical. Also, when the coupling unit 100 is not disposed at the bottom end of the door 30, although not shown in the drawings, an additional support member which supports the panel 40 may be disposed at the bottom end of the door 30 to support the panel 40 at the bottom end of the door 30.

Hereinafter, a coupling unit 100' of the refrigerator 1 according to one embodiment of the present disclosure will be described. Hereinafter, since other components in addition to the coupling unit 100' which will be described below are identical to the components of the refrigerator 1 according to one embodiment of the present disclosure, a repetitive description will be omitted.

Figure 7:
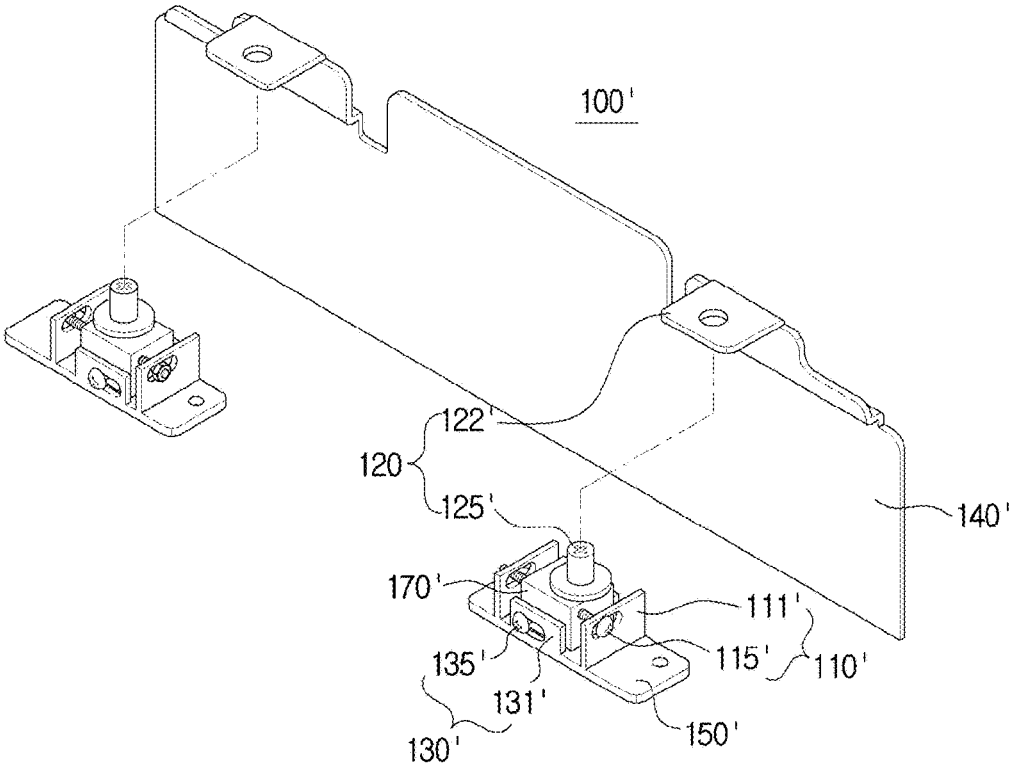
FIG. 7 is an exploded perspective view of the coupling unit of the refrigerator according to another embodiment of the present disclosure
Figure 8:
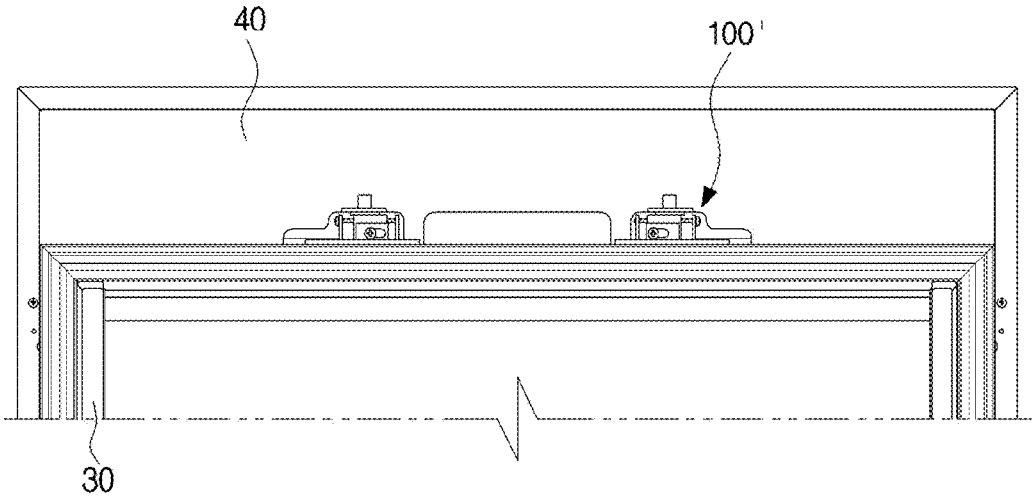
FIG. 8 is a rear view illustrating a state in which the panel is coupled to the coupling unit of the refrigerator according to another embodiment of the present disclosure.
Figure 9:
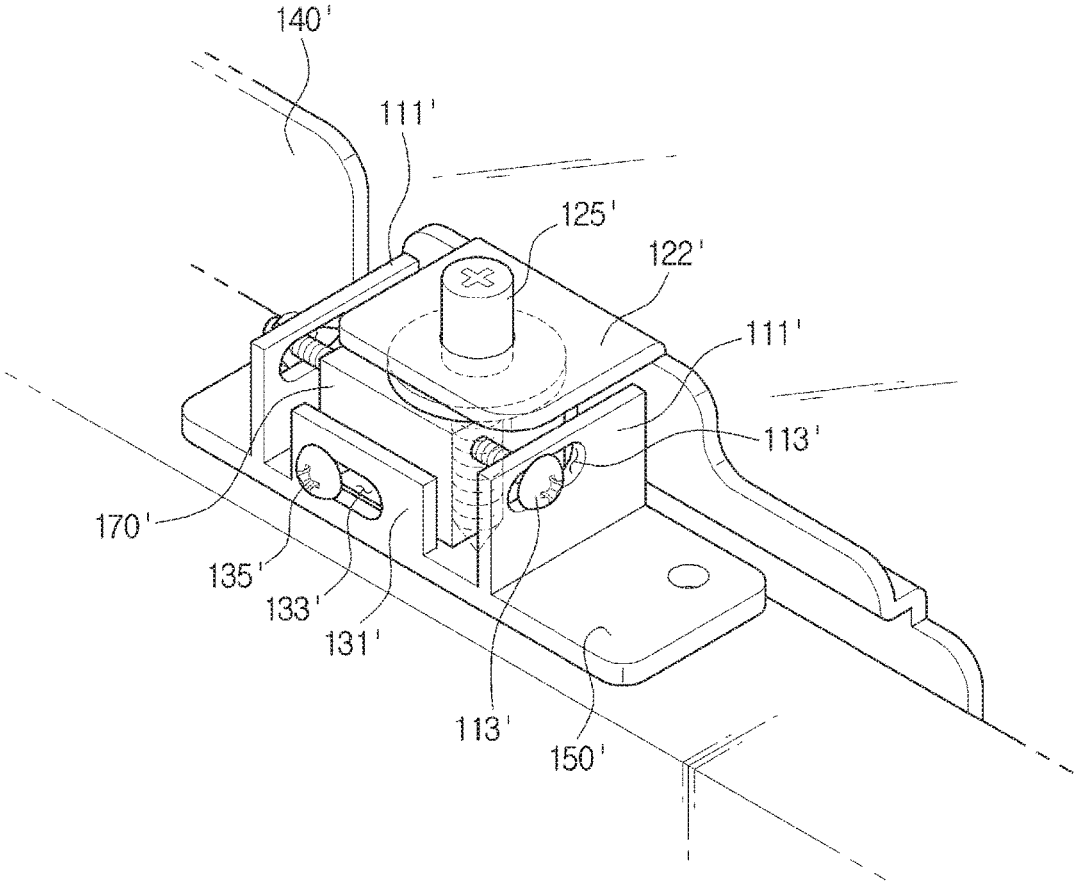
FIG. 9 is a perspective view illustrating a state in which the panel is coupled to the coupling unit of the refrigerator according to another embodiment of the present disclosure.

FIG. 7 is an exploded perspective view of the coupling unit of the refrigerator according to another embodiment of the present disclosure, FIG. 8 is a rear view illustrating a state in which the panel is coupled to the coupling unit of the refrigerator according to another embodiment of the present disclosure, and FIG. 9 is a perspective view illustrating a state in which the panel is coupled to the coupling unit of the refrigerator according to another embodiment of the present disclosure.

As shown in FIGS. 7 and 8, a pair of such coupling units 100' may be provided at the top end of the door 30. Since the pair of coupling units 100' are provided to be symmetrical to each other, hereinafter, only one of the pair of coupling units 100' will be described.

The coupling unit 100' may include a coupling bracket 140' coupled to a rear surface of the door 30 and a base bracket 150' coupled to the top end of the door 30. Also, the coupling unit 100' may include a first adjustor 110' which moves the panel 40 in a left and right direction, a second adjustor 120' which moves the panel 40 in an up and down direction, and a third adjustor 130' which moves the panel 40 in a front and rear direction.

Also, the coupling unit 100' may include a penetrating member 170' through which the three adjustors 110', 120', and 130' pass and which is provided to be movable in the left and right direction, the up and down direction, and the front and rear direction of the panel 40 by the three adjustors 110', 120', and 130'.

As shown in FIGS. 7 and 9, the first adjustor 110' may include a pair of first door brackets 111' extended upward from the base bracket 150' to have surfaces which face in the left and right direction of the panel 40.

The pair of first door brackets 111' may be disposed on both sides of the penetrating member 170'. The pair of first door brackets 111' may each include a first through hole 113' having a long side in the front and rear direction of the panel 40.

The first adjustor 110' may include a first adjustment member 115' with one end and the other end supported by the first through holes 113' provided at the pair of first door brackets 111' and which passes through the penetrating member 170' in the left and right direction of the panel 40.

A first rotator which is rotatable in one direction or an opposite direction by a user may be provided at one end of the first adjustment member 115'. When the user rotates the first rotator in one direction, the first adjustment member 115' may move the penetrating member 170' to one side through the rotation. When the first rotator is rotated in the opposite direction, the first adjustment member 115' may move the penetrating member 170' to an opposite side through the counter-rotation.

The second adjustor 120' may include a panel bracket 122' extending in the rear of the coupling bracket 140' and disposed to be parallel to the base bracket 150' in the up and down direction and a second adjustment member 125' screw-coupled, to a second through hole provided at an upper side of the penetrating member 170', in the up and down direction and configured to include a mounting portion on which the panel bracket 122' is mounted.

A part of the second adjustment member 125' may pass through the panel bracket 122' and may support a bottom surface of the panel bracket 122' through which the mounting portion passes to support the panel bracket 122' in the up and down direction of the panel 40.

A second rotator which is rotatable in one direction or an opposite direction by the user may be provided at one end of the second adjustment member 125'. When the user rotates the second rotator in one direction, the second adjustment member 125' is more strongly screw-coupled with the penetrating member 170' and moved downward through the rotation such that the panel bracket 122' mounted on the second adjustment member 125' may be moved downward. When the user rotates the second rotator in the opposite direction, the second adjustment member 125' is loosened from screw-coupling with the through hole 170' through the counter-rotation and is moved upward such that the panel bracket 122' mounted on the second adjustment member 125' may be moved upward.

The third adjustor 130' may include a second door bracket 131' extending upward from the base bracket 150' to be disposed to be parallel to the coupling bracket 140'.

The third adjustor 130' may include a third adjustment member 135' having an one end passed through and supported by a third through hole 133', and provided at the second door bracket 131' and passes through the penetrating member 170', and may be screw-coupled to the coupling bracket 140'. The third through hole 133' may be provided as a through hole long in a left and right direction.

A third rotator which is rotatable in one direction or an opposite direction by the user may be provided at one end supported by the third through hole 133' of the first adjustment member 135'. When the user rotates the third rotator in one direction, the third adjustment member 135' may move the penetrating member 170' frontward through the rotation. When the third rotator is rotated in the opposite direction, the third adjustment member 135' may move the penetrating member 170' rearward through the counter-rotation.

Hereinafter, a method of coupling the panel 40 with the door 30 by using the coupling unit 100' will be described.

The panel bracket 125' extending rearward from the coupling bracket 140' coupled to the bottom surface of the panel 40 may be mounted on the second adjustment member 125' in the up and down direction.

Afterward, the position of the panel 40 in the up and down direction may be adjusted by rotating the second rotator of the second adjustment member 125' in one direction or the opposite direction.

After the position of the panel 40 in the up and down direction is adjusted by the second adjustment member 125', the first adjustment member 115' may move the penetrating member 170' in the left and right direction by rotating the first rotator in one direction or the opposite direction.

Since the second adjustment member 125' is disposed above the through hole 170' as described above and the panel bracket 122' is mounted on the second adjustment member 125', when the penetrating member 170' is moved, the second adjustment member 125' is linked with the penetrating member 170' and moved in the left and right direction such that the panel bracket 122' may also be interconnected and moved. The panel 40, coupled with the coupling bracket 140' formed to be integrated with the panel bracket 122', may be linked with movement of the panel bracket 122' and moved in the left and right direction to be adjusted in position.

When the penetrating member 170' moves in the left and right direction, the third adjustment member 135' which passes through the penetrating member 170' may be linked therewith and moved in the left and right direction. Here, the third through hole 133' through which the third adjustment member 135' passes may restrict left and right movement of the third adjustment member 135'.

For prevent this, as described above, the third through hole 133' is long in the left and right direction not to restrict the third adjustment member 135' even when the third adjustment member 135' is moved in the left and right direction, and the third adjustment member 135' may be moved by a certain distance within the third through hole 133'.

After the position of the panel 40 in the left and right direction is adjusted by the first adjustment member 115', the third adjustment member 135' may move the penetrating member 170' in the front and rear direction by rotating the third rotator in one direction or the opposite direction.

The penetrating member 170' may move in the front and rear direction and pressurize the coupling bracket 140' in the front and rear direction to move the panel 40 in the front and rear direction.

When the penetrating member 170' moves in the front and rear direction, the first adjustment member 115', which passes through the penetrating member 170', may be linked therewith and moved in the front and rear direction. Here, the first through hole 113' through which the first adjustment member 115' passes may restrict front and rear movement of the first adjustment member 115'.

To prevent this, as described above, the first through hole 113' is long in the front and rear direction so as not to restrict the first adjustment member 115' even when the first adjustment member 115' is moved in the front and rear direction, and the first adjustment member 115' may be moved by a certain distance within the first through hole 113'.

After the position of the panel 40 is adjusted by movement of the penetrating member 170' in the up and down direction, the left and right direction, and the front and rear direction, the third adjustment member 135' may be rotated in one direction to be screw-coupled with the coupling bracket 140'. Due to this, after the position of the panel 40 is adjusted, the third adjustment member 135' may be finally coupled with the coupling bracket 140' to allow the panel 40 to be supported by the door 30.

As is apparent from the above description, a refrigerator in accordance with one embodiment of the present disclosure may include an adjustment apparatus capable of three-way adjustment of position in an up and down direction, a front and rear direction, and a left and right direction, and may allow a user to easily adjust a position of a panel in front of a refrigerator door by using one component.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator comprising:

a cabinet;

a door which opens a front of the cabinet;

a panel disposed in front of the door; and a coupling unit which couples the panel with the door, wherein the coupling unit comprises:

a first adjustor provided to adjust a position of the panel in a left and right direction;

a second adjustor provided to adjust a position of the panel in an up and down direction;

a third adjustor provided to adjust a position of the panel in a front and rear direction; and a penetrating member through which the first adjustor, the second adjustor, and the third adjustor pass, wherein the first adjustor comprises a first adjustment member which passes through the penetrating member in the left and right direction of the panel, wherein the second adjustor comprises a second adjustment member comprising a screw part configured to pass through the penetrating member in the up and down direction of the panel and is screw-coupled with the penetrating member, and wherein the third adjustor comprises a third adjustment member which passes through the penetrating member in the front and rear direction of the panel.

2. The refrigerator of claim 1, wherein the coupling unit further comprises:

a base bracket coupled to an end portion of the door; and a pair of first door brackets extending upward from the base bracket and disposed on left and right sides of the penetrating member, and wherein the first adjustment member comprises:

a rotator provided at one end of the first adjustment member and supported by one of the first door brackets;

a screw part configured to pass through the penetrating member; and a supporter provided at the other end of the first adjustment member and supported by the other of the pair of first door brackets.

3. The refrigerator of claim 2, wherein the coupling unit further comprises:

a coupling bracket coupled to a rear surface of the panel; and an extension portion extending rearward from the coupling bracket and provided to be parallel to the base bracket, wherein the second adjustment member further comprises a mounting portion on which the extension portion is mounted in the up and down direction of the panel.

4. The refrigerator of claim 2, wherein the coupling unit further comprises:

a coupling bracket coupled to a rear surface of the panel; and a second door bracket extending upward from the base bracket and disposed in the rear of the penetrating member, and wherein the third adjustment member passes through the second door bracket and the penetrating member in the front and rear direction of the panel and is screw-coupled with the coupling bracket.

* * * * *